US005632565A

United States Patent [19]

Yamaguchi

[11] Patent Number: 5,632,565

[45] Date of Patent: May 27, 1997

[54] REMOVABLE CAP WITH FLUID PASSAGE

[75] Inventor: Yasushi Yamaguchi, Tokyo, Japan

[73] Assignees: Colleague Iowa, Inc., Mt. Pleasant, Iowa; Colleague Agencies, Inc., Tokyo, Japan

[21] Appl. No.: 524,487

[22] Filed: Sep. 7, 1995

[51] Int. Cl.[6] ..... B43K 23/12

[52] U.S. Cl. ..... 401/202; 24/11 F; 401/213; 401/243; 401/247

[58] Field of Search ..... 24/11 F, 11 R; 401/202, 213, 243, 247

[56] References Cited

U.S. PATENT DOCUMENTS

| | | | |
|---|---|---|---|
| 1,247,957 | 11/1917 | Heath | 24/11 F |
| 3,842,466 | 10/1974 | Katz et al. | 24/11 F |

FOREIGN PATENT DOCUMENTS

| | | | |
|---|---|---|---|
| 319311 | 6/1989 | European Pat. Off. | 401/243 |
| 433532 | 6/1991 | European Pat. Off. | 401/213 |

*Primary Examiner*—Steven A. Bratlie
*Attorney, Agent, or Firm*—Kanesaka & Takeuchi

[57] ABSTRACT

A removable cap of the invention is used for an elongated or writing instrument. The cap is formed of a hollow main body, a supporting member projecting laterally from a side wall of the main body, and a clip projecting from a side of the supporting member. The main body includes an end opening at one side thereof, through which the elongated instrument is removably inserted into the hollow main body. The supporting member has a through hole therein. When the cap is accidentally swallowed and held in a throat, a fluid or air path is established in the supporting member.

6 Claims, 1 Drawing Sheet

REMOVABLE CAP WITH FLUID PASSAGE

BACKGROUND OF THE INVENTION AND RELATED ART STATEMENT

The present invention relates to a removable cap with a fluid passage for an elongated instrument. More particularly, the removable cap of the invention is used for a writing instrument and includes an air passage therein.

An elongated or writing instrument, such as a ball point pen and a marker, generally includes a cap for closing a tip of the writing instrument when it is not used. When the writing instrument is used, the cap is detached from the writing instrument. The detached cap may be put on a back end of the writing instrument, or placed on a desk or some other places. After using the writing instrument, the detached cap will be returned to cover the tip of the writing instrument, but the cap may be left as it is.

No matter if the cap is left alone or attached to a writing instrument, when a child or infant plays with the writing instrument or cap, the cap may be swallowed to thereby chock the throat. This kind of accident happens many times.

In order to prevent choking when the cap is swallowed, a hole penetrating through the cap may be formed. However, when the cap is properly fixed to the writing instrument, the cap must close the tip of the writing instrument completely to prevent evaporation of an ink of the writing instrument. The cap must have two contradictory functions therein.

In view of the above situation, there have been proposed many removable caps to provide air passages therein while completely closing the tip of the writing instrument when attached to the writing instrument.

In U.S. Pat. No. 4,915,529, a separate air channel is formed inside a cap while adding a partition in the cap.

In U.S. Pat. Nos. 5,061,105 and 5,427,464, a cap is formed of inner and outer shells. The inner shell completely closes the tip Of the writing instrument, while an air channel is established between the inner and outer shells.

In U.S. Pat. No. Des. 335,146 and U.S. Pat. No. 5,316,402, a plurality of ribs is formed on an outer surface of the cap to establish an air passage between the ribs.

In the prior art patents, an air passage is formed even if the cap is swallowed. However, in case the partition or inner shell is formed, the structure of the cap becomes complicated. On the other hand, if the ribs are formed on the outer surface of the cap, the appearance of the cap is impaired.

Accordingly, one object of the invention is to provide a removable cap with a fluid passage for an elongated or writing instrument, which has a simple structure to establish the fluid passage.

Another object of the invention is to provide a removable cap as stated above, which can be easily and economically manufactured.

A further object of the invention is to provide a removable cap as stated above, which does not impair appearance of the cap.

Further objects and advantages of the invention will be apparent from the following description of the invention.

SUMMARY OF THE INVENTION

In according with the invention, a removable cap is used for an elongated or writing instrument, such as a ball point pen and a marker. In the invention, even if the cap is accidentally swallowed by a child or an infant, fluid or air passage is established at the throat of the child to prevent choking.

The removable cap is formed of a hollow main body, a supporting member projecting laterally outwardly from the side wall of the main body, and a clip attached to the supporting member. The main body includes an end opening at one side thereof, through which the elongated or writing instrument is removably inserted into the hollow main body. The clip extends along the side wall, and is supported by the supporting member.

In the invention the supporting member has a width smaller than that of the main body, and includes a through hole therein to allow fluid or air to pass therethrough. In particular, the supporting member includes a bottom opening orienting along the longitudinal direction of the main body, and at least one side opening orienting perpendicularly to a projecting direction of the supporting member and the longitudinal direction of the main body. The through hole communicates between the bottom and side openings. Therefore, even if the removable cap is accidentally swallowed and held in a throat, air passes through the through hole or the cap.

In the invention, the width of the supporting member is less than that of the main body, and the side opening is formed at the side portion of the supporting member. Therefore, even if the cap is swallowed, the side opening is not blocked by the tissue. Also, since the clip is located above the bottom opening, the bottom opening is not blocked as well. Therefore, a fluid or air path is established in the supporting member to prevent choking at the throat even if the cap is swallowed.

Preferably, the supporting member includes two side openings extending perpendicularly to the bottom opening, and side projections extending outwardly therefrom. Notches communicating with the side openings are formed in the side projections. The notches extend along the longitudinal direction of the main body, which also establish the fluid path in the supporting member.

In the invention, the supporting member and clip are formed separately and fixed to the main body at a portion opposite to the end opening. The clip has an end fixed to the main body, and an engaging portion near the end. The engaging portion is located between the side projections of the supporting member, so that the clip is immovably held in the supporting member.

In the invention, the supporting member is only provided with the through hole therein, which can be made easily. The main body need not have any special structure. Therefore, the cap of the invention can be easily and economically made.

DETAILED DESCRIPTION OF A PREFERRED EMBODIMENT

Figure 3:
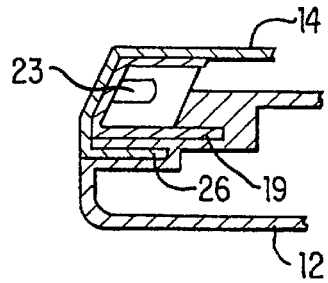
FIG. 3 is a partial section view of the cap taken along a line 3—3 in FIG. 2.

With reference to the drawings, the removable cap 10 of the present invention is explained below. In the drawings, the removable cap 10 is designed to cover a tip end of a ball point pen 11. However, the cap 10 may be used for other purpose, such as a marker and so on.

Figure 1:
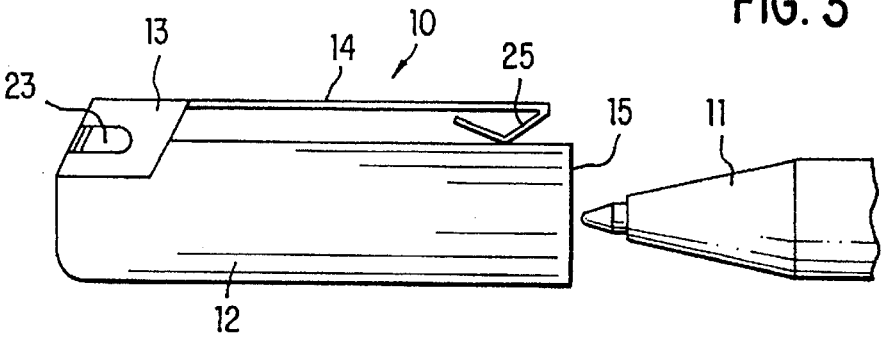
FIG. 1 is a side view of a cap of the invention, and a part of a ball point pen used together with the cap.
Figure 2:
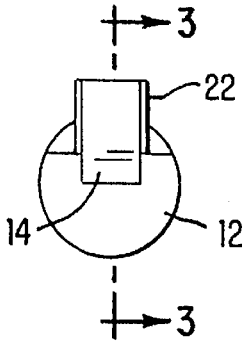
FIG. 2 is a left side view of the cap.
Figure 4:
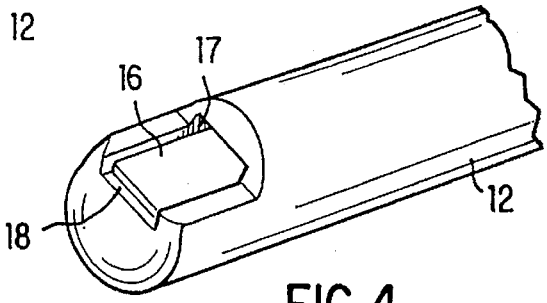
FIG. 4 is a partial perspective view of a main body.
Figure 8:
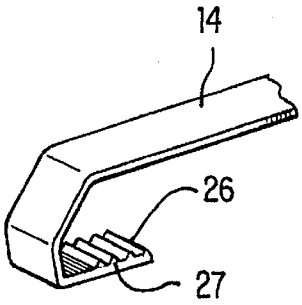
FIG. 8 is a partial perspective view of a clip.

The cap 10 is formed of a main body 12, a supporting member 13 and a clip 14 connected together. The main body 12 has an opening 15 at one side (FIG. 1), through which the ball point pen 11 is inserted. Also, the main body 12 includes an attaching portion 16 at a portion opposite to the opening 15, and holes 17 and 18. The supporting member 13 is mounted on the attaching portion 16 and partially inserted into the hole 17, while the clip 14 is inserted into the hole 18 for fixing. The holes 17 and 18 do not penetrate the main body 12, so that when the main body 12 covers the ball point pen 11, the tip end is securely sealed by the main body 12.

Figure 5:
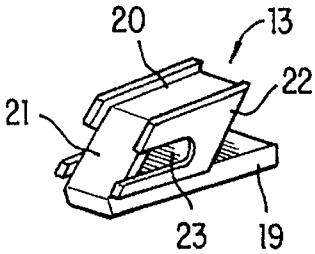
FIG. 5 is a perspective view of a supporting member.
Figure 6:
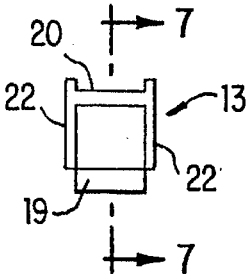
FIG. 6 is a side view of the supporting member.
Figure 7:
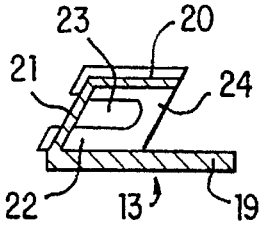
FIG. 7 is a section view of the supporting member taken along a line 7—7 in FIG. 6.

As shown in FIGS. 5–7, the supporting member 13 includes a base plate 19, an upper plate 20, a front plate 21 and two side plates 22. The side plate 22 has a notch 23 extending from a front side to form an opening together with the front plate 21. When the supporting member 13 is formed by the plates 19, 20, 21 and 22, a hollow space with a rear opening 24 is established.

The side plates 22 project upwardly beyond the upper plate 20 and forwardly beyond the front plate 21. The width between the projected portions of the side plates 22 corresponds to the width of the clip 14. Thus, when the clip 14 is placed on the supporting member 13, the clip 14 is snugly retained between the projected portions of the side plates 22.

The clip 14 has a holding portion 25 near the opening 15, and a bent portion 26 with small grooves or corrugations 27 at the opposite side of the holding portion 25. Near the bent portion 26, the clip 14 is bent along the upper plate 20 and the front plate 21 of the supporting member 13. When the clip 14 is fixed to the main body 12, the clip 14 is supported by the supporting member 13.

When the cap 10 is assembled, the base plate 19 of the supporting member 13 is placed on the attaching portion 16 and is inserted into the hole 17. The supporting member 13 is fixed in this position to the main body 12. Then, the bent portion 26 of the clip 14 is inserted into the hole 18 and is fixed to the main body 12. Since the grooves 27 firmly engage the main body 12 in the hole 18, the clip 14 does not disengage from the main body 12. When the clip 14 is fixed to the main body 12, a portion of the clip 14 is held between the projected portions of the side plates 22. Therefore, the clip 14 can be securely retained by the supporting member 13.

In the invention, when the cap 10 is accidentally swallowed by a child or infant and stops in the throat, the rear opening 24 is covered by the clip 14 to establish a space for the rear opening 24. Also, since the width of the supporting member 13 is less than that of the main body 12, a space is established between the side plate 22 and a tissue of the throat. Further, since the notch 23 extends in a direction opposite to the rear opening 24, the thickness of the notch 23 also forms a fluid path. Therefore, a sufficient fluid or air path is established in and around the supporting member 13 when the cap 10 is accidentally swallowed. Accordingly, it is possible to provide a sufficient time to remove the cap at a hospital. The cap 10 of the invention is safe for the child and infant.

In the present invention, the main body 12 and the supporting member 13 are formed of resin, and made by an injection molding. The clip 14 is made of metal to provide resiliency.

In the invention, the cap can be easily and economically manufactured while providing a safety fluid passage therein.

While the invention has been explained with reference to the specific embodiment of the invention, the explanation is illustrative and the invention is limited only by the appended claims.

What is claimed is:

1. A removable cap for an elongated instrument comprising:

an elongated hollow main body having a side wall, a width extending perpendicular to a longitudinal direction of the main body, and an end opening formed at one longitudinal end of the main body, through which said elongated instrument is removably inserted into the hollow main body, a supporting member formed separately from the main body and fixed to the main body to project laterally outwardly from the side wall of the main body, said supporting member having a width smaller than that of the main body, a bottom opening orienting in a direction as in the end opening, two side openings orienting in a width direction of the supporting member, and a T-shape through hole communicating between the bottom and side openings, and a clip formed separately from the main body and the support member and fixed to the other longitudinal end of the main body, said clip having a width less than that of the supporting member and projecting from the main body along an outer surface of the supporting member to be supported by the supporting member and to extend substantially along the side wall to form a space between the clip and the main body so that even if the removable cap is retained in a narrow portion, a fluid passage extending through said space, said T-shape through hole and a gap between the narrow portion and the clip adjacent to the support member is established between the cap and the narrow portion.

2. A removable cap according to claim 1, wherein said supporting member includes an upper plate, a front plate located at a portion opposite to the bottom opening, and two side plates situated on both sides of the upper and front plates and projecting outwardly beyond the upper and front plates to form projecting portions, each side plate having a notch for forming the side opening.

3. A removable cap according to claim 2, wherein said clip has an end fixed to the main body, and an engaging portion near the end, said engaging portion being situated between the projecting portions of the side plates so that the clip is immovably held by the supporting member.

4. A removable cap according to claim 3, wherein said supporting member further includes a base plate, and said main body has first and second openings, said base plate being inserted into the first opening and said end of the clip being inserted into the second opening.

5. A removable cap according to claim 2, wherein said notch formed in the side plate forms a path between the side opening formed therein and the other longitudinal end of the main body.

6. A removable cap according to claim 5, wherein said narrow portion is a throat.

* * * * *